United States Patent [19]

Brygger

[11] 4,138,187

[45] Feb. 6, 1979

[54] LIFT COVER ASSEMBLY FOR ELECTRICAL WIRING DEVICE

[75] Inventor: Flemming Brygger, Guilford, Conn.

[73] Assignee: Harvey Hubbell, Incorporated, Orange, Conn.

[21] Appl. No.: 859,299

[22] Filed: Dec. 12, 1977

[51] Int. Cl.[2] ..... H01R 3/04

[52] U.S. Cl. ..... 339/117 R; 174/67; 220/242; 339/44 R

[58] Field of Search ..... 339/117 R, 117 P, 36, 339/44 R, 114, 116 R; 174/66, 67; 220/241, 242

[56] References Cited

U.S. PATENT DOCUMENTS

| | | | |
|---|---|---|---|
| 2,870,933 | 1/1959 | Winter | 339/44 R |
| 3,140,344 | 7/1964 | Slater et al. | 339/44 R X |
| 3,189,212 | 6/1965 | Bellek | 339/44 R X |
| 3,950,055 | 4/1976 | Samuels et al. | 339/44 R |

*Primary Examiner*—Roy Lake
*Assistant Examiner*—DeWalden W. Jones
*Attorney, Agent, or Firm*—Jerry M. Presson

[57] ABSTRACT

Disclosed is a lift cover assembly which effectively shields and seals an electrical installation box having an electrical wiring device mounted therein against the entry of rain or other liquid sprays whether the lift cover is in a raised or in a closed position. With the lift cover in the raised position, the assembly also functions to shield the interface between intercoupled wiring devices. The assembly employs a unique, elastomeric member of overall substantially annular shape which is compressible and extendable upon the closing and opening, respectively, of the lift cover to accomplish these functions without sacrificing the narrow profile of the assembly.

21 Claims, 5 Drawing Figures

LIFT COVER ASSEMBLY FOR ELECTRICAL WIRING DEVICE

BACKGROUND OF THE INVENTION

This invention relates to a new and improved lift cover assembly for protecting electrical wiring installations from the entry of liquids.

Lift cover assemblies are used in conjunction with electrical wiring installations having male or female electrical devices mounted thereon to protect the installation against the entry of ambient liquids, particularly rain water.

Such assemblies typically comprise a lift cover pivotally mounted at one end to a mounting plate member mounted stationary against the outer surfaces of an installation box. It is usually desired that the mounting plate and the cover be flat and project only slightly beyond the outer surface of the installation box. From a functional standpoint, an assembly with such a narrow profile is less likely to obstruct or interfere with electrical cords and equipment used near or at the installation. Additionally, an assembly with a narrow profile is less obtrusive than one with a thicker profile and is therefore more esthetically acceptable to many users.

The lift cover is normally biased to a closed position by a coil spring mounted in the lift cover mounting. The lift cover protects the entry of the installation box against impinging liquid sprays when it is closed. The coil spring is designed to be wound up when the cover is raised and unwinds to restore the cover to its closed position when the cover is released. Communicating with the opening in the plate member and located inwardly of the closed cover is the front face of a wiring device. This device is usually a female type of wiring device, such as a female single or duplex receptacle, but it may also be a male type of device, such as an electrical plug. The free end of the lift cover may be raised manually against the bias of the spring to allow access to the front face of the female receptacle to permit insertion of the contacts of the appropriate male plug into the receptacle contacts. When the two devices are interconnected and the lift cover released, the spring unwinds causing the free end of the cover to rotate downward until it rests upon the male plug or upon the cable attached to and extending from the plug.

A circular gasket is typically mounted on the interior surface of prior art lift cover assemblies to abut the surface surrounding the plate opening. The gasket prevents the entry of water into the plate opening and into the receptacle contacts or other parts of the installation when the male plug is disconnected and removed from the receptacle and the cover is in its closed position. The liquids may be derived from rain, seawater spray, lawn sprinkling apparatus or from other ambient sources. Whereas, these prior art assemblies work effectively with the lift cover closed, they do not work nearly as effectively when the lift cover is raised. This is because the seal is raised with the cover and thusly removed from protecting the entry into the plate opening. In such case, it is possible for liquid to flow into the installation box through the opening in the front plate and over the interface between the mutually abutting front faces of the electrical plug and the electrical receptacle. Obviously, this liquid can cause direct corrosion problems. Moreover, the presence of water on the electrical contacts of the intercoupled wiring devices can accelerate the corrosion of the contacts through galvanic action.

Hitherto, the requirement for installations of this type was basically that the installation be shielded by the lift cover assembly from liquids issuing from above the assembly; that is, rain. The protection requirements are, however, becoming more stringent. The lift cover assembly is now required to shield the installation against the ingress of liquid sprays issuing from sources which are positioned below the installation, as well as above. Such sources would, for example, include lawn sprinklers of various types. Whereas this new requirement may be met by lift cover type of installations which project substantially from the surface on which they are mounted, as mentioned above, it is usually considered desirable that the lift cover assembly have a narrow profile from both the functional and esthetic viewpoints. The invention disclosed hereinbelow is intended to meet with these stringent requirements.

SUMMARY OF THE INVENTION

According to this invention, there is provided a lift cover assembly which effectively shields and seals an electrical installation box having an electrical wiring device mounted therein, against the entry of rain or other liquid sprays whether the lift cover is in a raised or in a closed position. With the lift cover in the raised position, the assembly also functions to shield the interface between intercoupled wiring devices. This invention is effective in preventing entry of liquids which are directed against the assembly from various directions while maintaining a depth dimension comparable to narrow profile types of prior art assemblies.

OBJECTS OF THE INVENTION

According to this invention, there is provided a new and improved lift cover assembly for shielding an electrical installation from the entry of rain or liquid sprays.

Another object of this invention is to provide a lift cover assembly for shielding and sealing an electrical installation having a standard wiring device mounted therein against the entry of rain water or liquid sprays.

Still another object of this invention is to provide an elastomeric member for use in conjunction with a lift cover assembly for shielding and sealing an electrical installation against the entry of liquids.

Yet another object of this invention is to provide a lift cover assembly for use in an electrical installation for shielding a wiring device with or without a protective boot mounted thereon from entry of liquids while connected to a mating wiring device mounted in the installation.

A further object of this invention is to provide a lift cover assembly having a relatively thin profile.

Yet another object of this invention is to provide an all-weather lift cover assembly which is relatively inexpensive to manufacture and easy to use.

BRIEF DESCRIPTION OF THE DRAWINGS

The manner by which these and other objects of this invention are achieved will be best understood by reference to the following figures of the attached drawing wherein.

DETAILED DESCRIPTION

Figure 1:
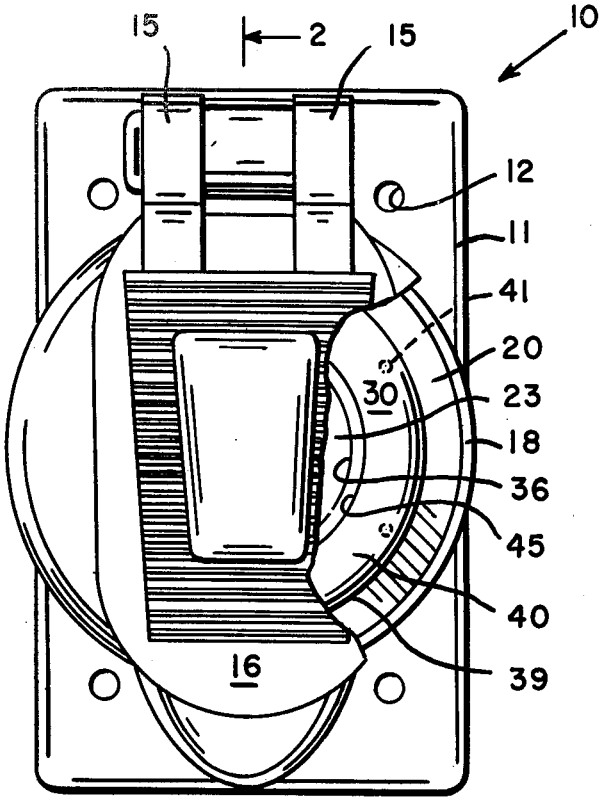
FIG. 1 is a front plan view of a lift cover assembly constructed in accordance with this invention with part of the lift cover shown broken away to more clearly illustrate an underlying sealing member constructed in accordance with this invention.
Figure 2:
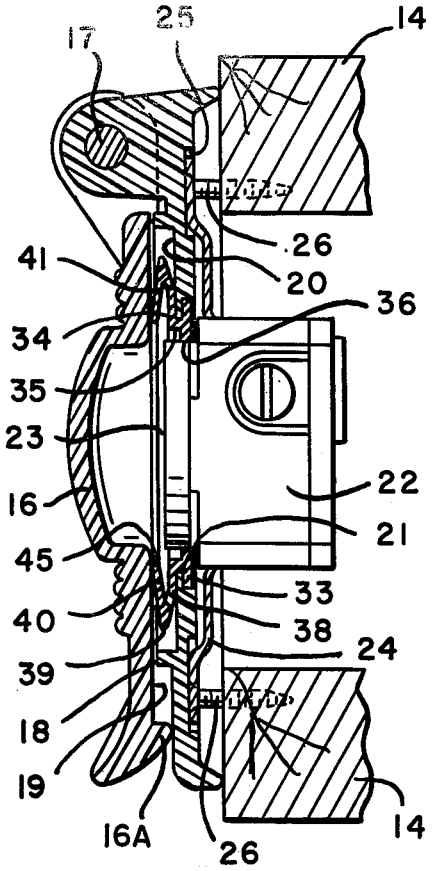
FIG. 2 is a side elevation of the assembly taken along section lines 2—2 of FIG. 1 and depicts the lift cover assembly in a closed position sealing the central opening in a mounting plate overlying the entrance of an installation box.

With reference to FIG. 1 of the drawings, numeral 10 designates a lift cover assembly constructed in accordance with this invention for shielding and sealing an electrical inlet installation. The assembly comprises a generally planar plate 11 having four through-holes 12 spaced adjacent the corners of the plate to accommodate mounting screws (not shown). The plate 11 is designed to abut the front edge of a conventional surface mounted metal or plastic installation box 14 as shown in FIG. 2. A sealing gasket (not shown) is usually placed between the opposing surfaces of the plate 11 and the front end surface of the box 14. The mounting screws which pass through the openings 12 are received in threaded apertures (not shown) extending into the front end surface of the installation box 14 and thereby serve to fixedly secure the lift cover assembly over that end of the box 14. As will be apparent to those skilled in the art, the plate 11 also may be designed for use with a flush-mounted type of installation box (not shown).

A pair of laterally spaced apart legs 15 of cover 16 are journaled for pivotal movement on a horizontal pin 17. A coil spring (not shown) is mounted on the journal 17 to bias the lower and free end of the cover 16 downwardly to the closed position, substantially as illustrated in FIG. 2 where an inwardly projecting cover stop 16A abuts a lower part of the plate. This type of spring-biased cover mounting is conventional and therefore, further description is not warranted.

The frontward face of the plate 11 is provided with an annular flange 18 spaced slightly rearwardly of the opposing, interior flat portion 19 of the cover 16 when the stop 16A rests against the plate. This spacing is sufficient to allow liquid accumulating between the cover 16 and the flange 18 to flow by gravity out the lower end of the flange 18 and past the sides of the stop 16A as viewed in FIG. 1, and hence, from the installation. The plate flange 18 circumscribes a flat surface 20 which is circular in plan view and extends radially inwardly from the flange 18 to terminate in a circular plate rib 21. The rib 21 is spaced from and surrounds the exterior surface of the face of the wiring device mounted in the inlet and defines the plate opening. Typically, the wiring device is a conventional female receptacle 22 having a cylindrical front face 23 formed with a plurality of axially extending apertures for housing the various female electrically conductive contacts forming part of the receptacle.

The receptacle 22 is mounted in the box 14 by means of a diametrically disposed mounting strap 24. The strap 24 is permanently attached to the receptacle and removably attached at each end to the front edge of the box 14 by means of two machine screws 26. The screws 26 are passed through horizontally elongated mounting holes formed in the opposite ears of the strap 24. The strap ears are accommodated in an annular recess 25 formed in the rearward surface of the plate 18. The screws 26 engage threaded apertures extending horizontally into the front end of the box 14. The strap 24 is typically positioned symmetrically with respect to the vertical axis of symmetry of the box 14 and therefore, the screws 26 are located intermediate the screws (not shown) which are inserted in the mounting holes 12 and tightened down to secure the plate 11 to the box 14. To assemble, the female receptacle 22 is initially mounted in the box 14 by tightening the screws 26, the recess 25 of the lift cover plate 11 is placed over the strap ears and the cover plate is then secured to the front end of the box 14. Alternatively, the wiring device could be mounted directly against the rearward surface of the cover plate.

Figure 3:
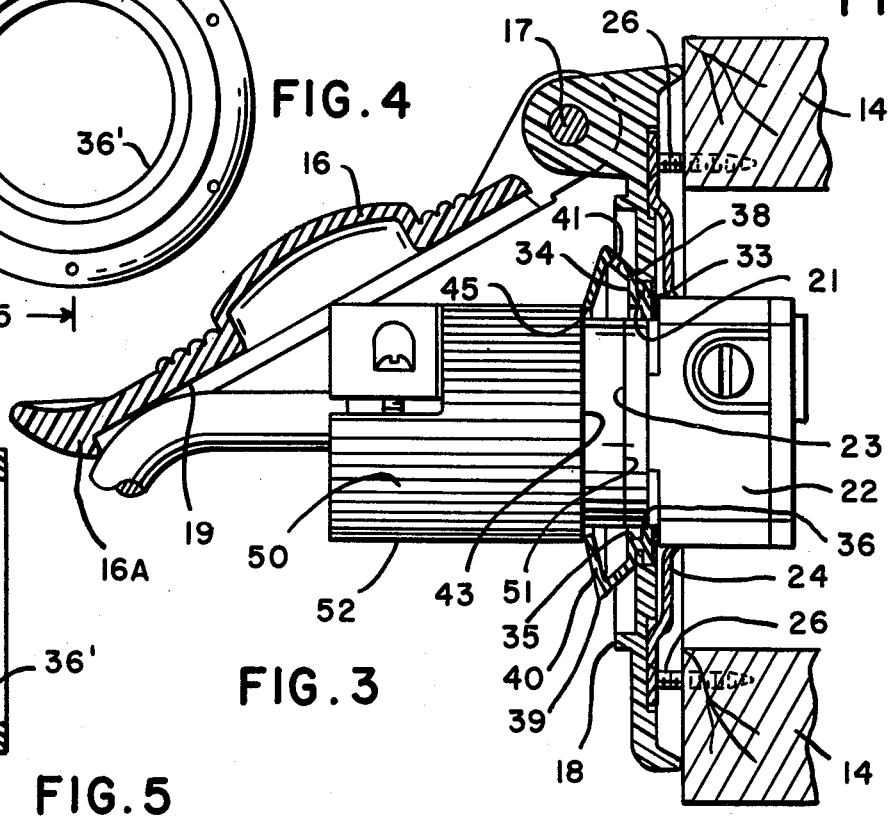
FIG. 3 is a side sectional view taken through section lines 2—2 of FIG. 1 illustrating two interconnected conventional wiring devices mounted in the lift cover assembly.

It is preferred that the front face 23 of the receptacle 22 be shielded against entry of water or other liquids which may impact at various angles against the face 23 whether the lift cover is in its raised or closed position. As will be apparent, when the cover is closed, the shielding effectiveness of the assembly to liquid sprays impinging parallel or nearly parallel to the device axis, which is one of the worst case conditions, is good. Nonetheless, the instant assembly also shields the installation from such sprays when the cover rests in its raised position upon an interconnecting electrical device, as shown by FIG. 3. As mentioned hereinabove, prior art lift cover assemblies which have the desired narrow profile dimension employ a circular gasket secured to the rearward surface of the lift cover which abuts the outer surface of the lift cover plate, or some type of equivalent means that assists in sealing the entry of the installation against the entry of liquids when the cover is closed. The disadvantages with these arrangements is that when the lift cover is raised, the front face 23 of the receptacle and the surrounding plate opening are not shielded and sealed from the entry of liquids.

When the cover is closed, this invention seals against liquid entering the installation box through the plate opening and also, seals against liquid flowing across the face of the receptacle mounted in the box. When the cover is raised, the assembly seals against liquid entering the installation box through the plate opening and with the mating plug connected to the receptacle, shields the interface between the female receptacle and the mating male plug from entry of the liquid. This latter shielding can be effected whether or not the male plug carries a conventional rubber protective boot.

To perform these diverse functions, the assembly employs a unitary member 30 molded of an impervious, elastomeric material of good electrical insulative properties, such as rubber or polyvinylchloride. The member may be formed inexpensively by a single molding operation and may be manipulated for easy insertion in the assembly. The member 30 includes a sealing portion comprised of rearward and frontward flange sections 33 and 34, respectively. These sections are radially parallel, circular in plan view and of substantially equal diameter. A laterally disposed annular section 35 joins the sections 33 and 34. The lateral spacing between the two parallel flange sections parallel to the major or longitudinal axis of the receptacle 22 is just slightly greater (typically, 0.003 inch greater) than the lateral dimension of the rib 21 so that an interference fit is provided between the sections and the rib to ensure that a liquid seal exists between both sections and their underlying rib surfaces.

The cross-sectional area of the rearward section 33 is made great enough to ensure that the section 33 has sufficient rigidity to resist axial displacements caused by forces which tend to displace the member axially. These forces are typically produced during normal usage of the assembly when, for example, the cover is raised. To ensure this rigidity, the width of the section 33 is about twice the width of the section 34. An annular recess can be cut into the rearward surface of the rib 21 to permit one size of the member 30 to be used with plates of different thickness in the region surrounding the plate opening. In addition to, or in lieu of, the liquid sealing provided between the sections 33 and 34 and the rib surfaces interposed therebetween, a liquid seal may also be effected by annular section 35 contacting the corresponding inner edge of the rib 21 with an interference fit. The diameters of the rib and section 34 may be appropriately dimensioned to provide that fit. Moreover, if desired, suitable adhesives may be applied to any one or all of the rib surfaces that contact the sections 33, 34 and 35 to further ensure a liquid-tight seal along one or more of the corresponding rib surfaces.

A flexible sealing flap 36 depends from the section 35, extending radially inwardly from that section. The flap 36 has a slightly smaller diameter than the corresponding diameter of the underlying cylindrical surface of the receptacle so that the flap provides sealing contact with that surface.

With reference to FIGS. 2 and 3, a flexible section 38 is joined to and slopes outwardly from the section 34. In its relaxed or expanded state, the section 34 extends slightly forwardly of the plane of the section 34 and the plane of the flange 18. A peripheral edge 39 of circular shape defines the junction of the section 38 and a flexible section 40. The section 40 depends from the edge 39 and slopes inwardly toward the axis. Hence, the sections 38 and 40 intersect at the edge 39 and depart therefrom with slopes of opposite sign to form, in effect, a single, substantially V-shaped pleat of an axially extendable and compressible bellows section. When the sections are in a freely extended condition, as shown in FIG. 3, the interior angle of the trough formed by the intersection of the inner sloping surfaces of the sections 38 and 40 is typically a complementary angle ranging from about 60° to about 90°. Liquid entering between the closed cover and the plate is caused to flow around the oppositely inclined outer surfaces of the sections 38 and 40 and their respective abutting plate and cover surfaces. This liquid egresses from the lower end of the assembly through the open spaces on both sides of the stop 16A.

Spaced circumferentially around and extending transversely through the section 38 adjacent the edge 39 are a plurality of equi-spaced vent holes or apertures 41. The number of vent holes is preferably such that at least one vent hole will always be in a position below a horizontal plane passing through the lowermost lips of the sections 38 and 40 and hence, the level of liquid which could otherwise be collected in the trough regardless of the circumferential orientation of the member 30 on the rib. By providing six or more equi-spaced holes, this desired liquid venting condition always will be maintained.

The holes 41 serve two important functions; firstly, to allow the egress of liquid which is collected in the circular trough formed by the oppositely sloping interior surfaces of the two sections 38 and 40, and secondly, to permit air to enter between the opposing interior surfaces of these sections. In performing the first function, liquid collected in the trough flows by gravity through the lowermost hole or holes 41 from whence it can flow from the installation. The removal of water from the trough reduces the possibility that liquid collected in the trough will freeze and prevent free axial extendability and compressibility of the sections. In fulfilling its second function, the holes vent the trough between the opposite surfaces of the sections 38 and 40 in order to prevent a vacuum or lower-than-ambient pressure area from being created between the moist surfaces defining the trough once the sections 38 and 40 are pressed together by, for example, cover closure. The creation of a vacuum or low pressure area in the trough might inhibit the free separation and extendability of the sections 38 and 40 once the compressive forces are removed upon, for example, the opening of the cover.

Figure 4:
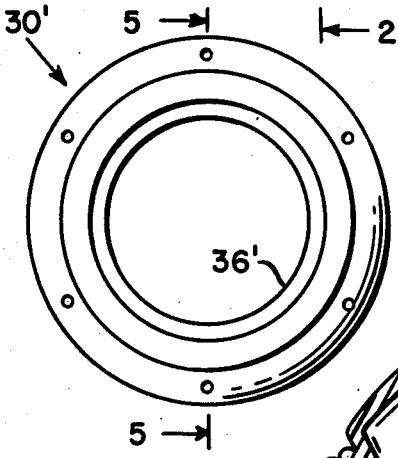
FIG. 4 is a plan view of another embodiment of the shielding and sealing member constructed in accordance with this invention, as viewed from its rearward end.

When the lift cover 16 is raised, the released sections 38 and 40 separate and extend freely frontwardly from the surface 20 and the receptacle face 23 to deflect and thereby shield the face 23 against the entry of liquids. To permit the unobstructed axial insertion of a conventional male plug 50 into the receptacle 22 while the cover 16 is raised, FIG. 4, the lip 45 is designed with a greater diameter than the corresponding dimension of the front face 51 of the plug. The lip 45 may have a slightly greater diameter than that of the body 52 of the plug. In such case, the section 40 is free to extend further forwardly and form a liquid-deflecting shield with the underlying portion of the plug body 52.

The assembly accepts a wide variety of plugs which are designed for the receptacle, regardless of whether the plugs are smaller or larger in diameter than the lip 45. If the plug is smaller in diameter, the sections 38 and 40 will still give the receptacle a suitable protection and if the plug is larger, or if the plug is covered with a conventional elastomeric protective boot (not shown), the sections 38 and 40 will compress and the face end of the plug or its boot will interface with the section 40 to form a liquid-deflecting shield. This shield is located frontwardly of the plate opening and the interface between the front faces of the interconnected wiring devices. The diameter of the lip 45 should, however, be larger in diameter than the diameter of the receptacle face to ensure that the lip will not obstruct the desired connection of the two wiring devices.

Figure 5:
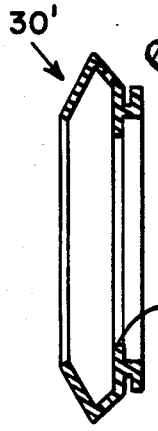
FIG. 5 is a sectional side view taken along section 5—5 of FIG. 4.

For some applications, the sealing flap may be positioned near or at the frontward end of the lateral section 34, as depicted by FIG. 5. In this figure, the flap 36 of the member 30 lies in the same plane as the section 34. Alternatively, two flaps may be provided at the frontward and rearward ends of the lateral section to provide a plurality of seals against the entry of liquids between the outer frontward surface of the wiring device mounted in the installation and the plate opening.

While one advantageous embodiment has been chosen to illustrate the invention, it will be understood by those skilled in the art that various changes and modifications can be made therein without departing from the scope of the invention as defined in the appended claims.

I claim as my invention:

1. A member composed of an elastomeric material for shielding and sealing the interior of an electrical assembly against the entry of liquids, the assembly including a lift cover pivotally mounted on a flat cover plate having a substantially circular opening therein defined by a substantially circular interior plate edge, the front face of a first electrical wiring device communicating with the opening, said member comprising:

a sealing section comprising two substantially parallel portions extending radially outwardly from an axis which extends substantially perpendicularly to said plate centrally of said opening, at least one of said portions bearing against a surface of said plate adjacent the plate edge thereof, and a lateral portion for joining said portions and holding said portion in liquid-sealing contact with said plate surface, a first axially compressible shielding section joined to the frontwardmost one of said portions to extend outwardly and frontwardly therefrom, a second axially compressible shielding section joined to, and extending frontwardly of, said first shielding section along a common peripheral edge, said second shielding section inclined inwardly toward said axis to define a radial aperture of sufficient size to accommodate therein a second wiring device electrically connected to the first wiring device, the first and second sections having interior surfaces of oppositely directed slope which intersect to form a liquid-collecting trough therebetween, and at least one aperture extending through one of the flexible sections adjacent said peripheral edge for venting the trough.

2. The member according to claim 1 which further includes a flexible sealing flap depending from said lateral portion for surrounding and sealing an exterior surface of one of said wiring devices.

3. The member according to claim 2 wherein said flap is mounted substantially opposite the rearwardmost parallel portion of said sealing section.

4. The member according to claim 2 wherein the flap is mounted substantially opposite the frontwardmost one of said parallel portions of said sealing section.

5. The member according to claim 1 wherein there are at least six said apertures equi-spaced around said first flexible section inwardly of said peripheral edge.

6. The member according to claim 1 wherein the second shielding section extends frontwardly of the cover plate opening sufficiently to shield the abutting faces of the first and second wiring devices and being displaced axially rearwardly upon closure of the cover when the second wiring device is removed to form a liquid seal with the interior of the cover.

7. The member according to claim 6 wherein the angle defined between the interior surfaces of said shielding sections when said shielding sections are freely extendable ranges from about 60° to about 90°.

8. The member according to claim 1 wherein the two parallel and lateral portions form a sealing section of substantially U cross-sectional shape around said circular plate edge.

9. The member according to claim 8 wherein said shielding sections are axially compressible and extendable upon the respective closing and opening of the lift cover.

10. A lift cover assembly for inhibiting the entry of liquids into an electrical installation box housing an electrical wiring device, comprising:

a substantially flat plate member mounted over the front entrance to the installation box having respective rearward and frontward surfaces, a first electrical wiring device mounted in the installation box, an opening for providing access to the front face of the wiring device, the opening extending perpendicularly through the plate member substantially centrally thereof, and defined in part by an inwardly projecting plate edge of a large enough cross-sectional area to permit electrically connective access to the electrical contacts of the wiring device, said edge having respective rearward and frontward surface portions, an annular recess in said rearward surface portion of said edge, a lift cover mounted on the upper end of the forward surface of the plate member for pivotal movement about an axis substantially perpendicular to the plane of said member, whereby said lift cover respectively opens and closes the opening, a unitary member composed of a flexible, electrical insulating material for inhibiting entry of liquids into the opening, comprising:

a sealing section mounted on said edge and comprised of frontwardly and rearwardly disposed elements extending radially from said axis and a base element substantially parallel to said axis joining said parallel elements laterally, the lateral spacing between the two parallel elements being substantially equal to the dimension of said edge parallel to said axis so that underlying surface portions of said edge are sealed against the entry of liquid, the rearward element mounted in said annular recess in said rearward surface portion, a first liquid shielding section of substantially rectangular cross-section sloping outwardly from the forwardmost one of the parallel elements and extending frontwardly concentric with said axis, a second liquid shielding section of substantially rectangular cross-section joined to said first portion along a common circular peripheral surface of greater internal diameter than said edge, said section sloping inwardly from said surface concentric with said axis to terminate in a lip of substantially circular cross-sectional shape, said lip being substantially concentric with respect to said axis and having a large enough diameter to accommodate a second electrical wiring device for electrical connection to the first wiring device, said first and second sections having oppositely inclined interior surfaces forming a liquid collecting trough therebetween; and at least one aperture formed in one of said shielding sections proximate the lower end of the trough and adjacent said peripheral edge for venting the trough bottom to ambient pressure.

11. The assembly as claimed in claim 10 and further comprising:

a flexible sealing flap depending from said base element of said sealing section for surrounding and sealing an exterior surface of one of the wiring devices against entry of liquids.

12. A lift cover assembly as claimed in claim 10 wherein the first wiring device is a female receptacle and the second wiring device is a male plug having a cylindrical exterior surface portion located frontwardly of the front surface of said plate member.

13. A lift cover assembly as claimed in claim 12 wherein the circular lip of said second shielding section closely surrounds said exterior surface portion of the male plug to inhibit the entry of liquids therebetween.

14. A lift cover assembly as claimed in claim 11 wherein said sealing flap defines an opening of substantially circular shape and of a diameter such that the flap closely surrounds a cylindrical exterior surface portion of the male plug between the rearward and forward plate surfaces to inhibit the passage of liquid therebetween.

15. A lift cover assembly as claimed in claim 14 wherein the forward end of the female receptacle has a substantially cylindrical surface portion and wherein said flap defines an opening of substantially circular shape and of a diameter such that the flap closely surrounds the surface portion of the receptacle to prevent the passage of liquid therebetween.

16. A lift cover assembly as claimed in claim 15 wherein the interior diameters of said lip and said base section are substantially equal, and further, wherein the diameter of the flap opening is less than the lip and base diameters.

17. The assembly as claimed in claim 10 wherein said second section of said member projects beyond the plate member when said cover is in a fully open position and the second wiring device is removed, whereby upon closure of the lift cover with the second device absent, said second section cushions and bears against the interior cover surface to inhibit the entry of liquid therebetween, and means for providing a channel communicating with the lower portion of the member and the exterior of the plate member to vent the exterior and interior surfaces of said second section.

18. The assembly as claimed in claim 10 wherein said rearward element mounted in said annular recess has substantially the same diameter but a greater cross-sectional area than said frontward element to enhance the rigidity of the seal between the rearward element and the recess.

19. A member for shielding the interior of an electrical assembly protected by a lift cover against the entry of liquids, the member being substantially circular in plan and composed of an elastomeric material, and comprised of a plurality of sections joined along a common edge for axial compression and expansion by the lift cover, said sections intersecting to form outer surfaces of oppositely directed slopes for diverting liquids received thereby and forming inner surfaces of oppositely directed slopes for collecting liquid received thereby, means for mounting one of said sections with a liquid-tight seal to a surface communicating with the interior of the electrical assembly, whereby liquid received by the section adjacent the one section is inhibited from flowing into said assembly, and at least one channel formed in one of said sections for venting said inner surfaces thereof.

20. In a lift cover assembly for protecting an electrical installation box, a unitary, substantially annular member composed of a molded, flexible material, a portion of said member having opposed walls joined along one edge thereof to provide a protective shield of substantially V cross-sectional shape, and a plurality of holes extending through one of the opposed walls and spaced circumferentially therearound to vent the area between the walls.

21. The annular member as claimed in claim 20 wherein the member is mounted substantially vertically and further, wherein there are at least six holes equispaced around the edge of the one wall, whereby liquid collected in the area between the walls vents by gravity from the member regardless of the circumferential orientation of the member in the assembly.

* * * * *